US011383899B2

(12) United States Patent
Twist et al.

(10) Patent No.: US 11,383,899 B2
(45) Date of Patent: Jul. 12, 2022

(54) TAMPER-RESISTANT CONTAINER

(71) Applicant: Entwisted, Inc., Newport Beach, CA (US)

(72) Inventors: Jordan R. Twist, Newport Beach, CA (US); Tracy J. Twist, Newport Beach, CA (US); Dale Woiken, Rancho Cucamonga, CA (US)

(73) Assignee: ANHINGA CO., Superior, CO (US)

( * ) Notice: Subject to any disclaimer, the term of this patent is extended or adjusted under 35 U.S.C. 154(b) by 60 days.

(21) Appl. No.: 16/521,347

(22) Filed: Jul. 24, 2019

(65) Prior Publication Data

US 2020/0039708 A1 Feb. 6, 2020

Related U.S. Application Data

(60) Provisional application No. 62/712,410, filed on Jul. 31, 2018.

(51) Int. Cl.
*B65D 55/10* (2006.01)
*B65D 50/04* (2006.01)

(52) U.S. Cl.
CPC ..... *B65D 50/046* (2013.01)

(58) Field of Classification Search
CPC ..... B65D 55/10; B65D 55/12; B65D 55/14; B65D 2313/04; E05B 47/0038; E05B 47/004; F17C 1/08; F17C 2203/012; Y10T 292/11; Y10T 292/1016; Y10S 292/11
USPC ..... 220/328, 230, 262, 260, 326, 281, 327, 220/315
See application file for complete search history.

(56) References Cited

U.S. PATENT DOCUMENTS

| | | | | |
|---|---|---|---|---|
| 1,534,341 | A * | 4/1925 | Bernotow | B65D 51/30 292/37 |
| 3,126,139 | A | 3/1964 | Schechter | |
| 3,275,726 | A | 9/1966 | Rudolph | |
| 3,294,271 | A | 12/1966 | Armbruster | |
| 3,377,757 | A | 4/1968 | Magers, Jr. | |
| 3,386,273 | A * | 6/1968 | Green | B65D 50/067 70/168 |
| 3,450,289 | A | 6/1969 | Esposito, Jr. | |
| 3,612,036 | A | 10/1971 | Kaufman | |
| 3,917,097 | A | 11/1975 | Uhlig | |
| 3,989,152 | A | 11/1976 | Julian | |
| 4,053,077 | A | 10/1977 | DeFelice | |
| 4,203,479 | A | 5/1980 | Mathews | |
| 4,558,796 | A | 12/1985 | Jaicks | |
| 4,666,054 | A | 5/1987 | Jaicks | |
| 4,801,039 | A | 1/1989 | McCall et al. | |

(Continued)

FOREIGN PATENT DOCUMENTS

| | | | |
|---|---|---|---|
| DE | 370426 C | * | 3/1923 |
| FR | 775479 A | * | 12/1934 |
| GB | 191316714 A | * | 12/1913 |

*Primary Examiner* — Allan D Stevens
(74) *Attorney, Agent, or Firm* — Stetina Brunda Garred and Brucker

(57) ABSTRACT

A tamper-resistant container defining an opening extending into a canister chamber; a lid sized and configured to engage the canister rim for closure of the opening; a locking pin having a locked position with the locking pin being engaged with the canister for mitigating disengagement of the lid from the canister rim; and a locking actuator attached to the lid, sized and configured to move the locking pin from the unlocked position.

13 Claims, 7 Drawing Sheets

(56) References Cited

U.S. PATENT DOCUMENTS

| | | | | |
|---|---|---|---|---|
| 5,078,288 | A | 1/1992 | Fuchs | |
| 5,344,109 | A | 9/1994 | Hokoana, Jr. | |
| 5,411,161 | A | 5/1995 | Fish, Jr. | |
| 5,462,182 | A | 10/1995 | Opresco | |
| 5,638,977 | A | 6/1997 | Bianchi | |
| 5,687,863 | A | 11/1997 | Kusz | |
| 5,706,963 | A | 1/1998 | Gargione | |
| 5,829,609 | A | 11/1998 | Beck | |
| 5,884,815 | A | 3/1999 | Stolz | |
| 5,908,127 | A | 6/1999 | Weick et al. | |
| 5,947,320 | A | 9/1999 | Bordner et al. | |
| 5,950,981 | A | 9/1999 | Judy | |
| 5,967,352 | A | 10/1999 | Repp et al. | |
| 5,967,362 | A | 10/1999 | Corbin | |
| 6,036,036 | A | 3/2000 | Bilani et al. | |
| 6,056,143 | A | 5/2000 | Stolzman | |
| 6,112,291 | A | 8/2000 | Scales et al. | |
| 6,168,035 | B1 | 1/2001 | McLelland | |
| 6,279,766 | B1 | 8/2001 | Jones et al. | |
| 6,332,713 | B1 | 12/2001 | Cohen | |
| 6,343,709 | B1 | 2/2002 | DeForrest et al. | |
| 6,350,418 | B1 * | 2/2002 | Venderpool | B65D 55/12 292/37 |
| 6,568,550 | B2 | 5/2003 | Takiguchi | |
| 7,128,233 | B2 | 10/2006 | Hogan | |
| 7,726,507 | B2 * | 6/2010 | Wickland | G21F 5/005 292/6 |
| 8,146,769 | B2 | 4/2012 | Hogan | |
| 9,021,841 | B2 * | 5/2015 | Kottenstette | E05B 47/004 70/168 |
| 2005/0061829 | A1 | 3/2005 | Thielking | |
| 2007/0134061 | A1 * | 6/2007 | Nance | F16B 21/165 403/362 |
| 2008/0185385 | A1 * | 8/2008 | Grampassi | B67D 3/0058 220/326 |
| 2011/0241828 | A1 * | 10/2011 | Wang | B65D 41/04 340/5.53 |
| 2013/0256256 | A1 * | 10/2013 | Krippendorf | E05B 43/005 215/200 |
| 2018/0229863 | A1 * | 8/2018 | Veto | B64G 1/402 |

* cited by examiner

TAMPER-RESISTANT CONTAINER

CROSS-REFERENCE TO RELATED APPLICATIONS

This application relates to and claims the benefit of U.S. Provisional Application No. 62/712,410 filed Jul. 31, 2018 and entitled "TAMPER RESISTANT CONTAINER," the entire contents of which is expressly incorporated herein by reference.

STATEMENT RE: FEDERALLY SPONSORED RESEARCH/DEVELOPMENT

Not Applicable

BACKGROUND

1. Technical Field

The present disclosure relates generally to tamper resistant containers. More particularly, the present disclosure relates to a tamper resistant container with a lid with locking pin actuated by a circular disc.

2. Related Art

Storage containers have a wide variety of usages. One such usage is for the storage of materials in a manner that are tamper-resistant or otherwise protects against opening by animals and children. For example, a variety of storage containers that have been specifically designed to address the problem of animals, such as bears, opening the containers. These storage containers are useful for the storage of food and provisions, such as when camping or enjoying other outdoor activities. An example of such a container is disclosed in U.S. Pat. No. 8,146,769 entitled TAMPER-RESISTANT CONTAINER AND METHODS, issued on Apr. 3, 2012. Generally, such a tamper-resistant container features a lid that is able to be secured and locked in a manner that mitigates being opened by a bear, while also being able to be readily opened by the person using the container. Although such tamper resistant containers have proven generally suitable for their intended purpose, they have experienced deficiencies in that bears have found it possible to open or rupture the container and such containers have, in some instances, been difficult to open by a user.

In view of the foregoing, there is a need in the art for an improved tamper resistant container.

SUMMARY OF THE PRESENT INVENTION

The present invention specifically addresses and alleviates the above-referenced deficiencies associated in the art. More particularly, the tamper-resistant container of the present invention has an opening as well as a lid sized and configured to engage the rim of a canister for closure of the opening. A locking pin includes a locked position for mitigating disengagement from the lid from the canister rim and an unlocked position to allow the canister to be opened by a user. The canister may be formed of a durable tough plastic material and preferably includes structural ribs distributed within the canister side walls. The structural ribs may be used to enhance the structural integrity (i.e., provide increased compaction and crush strength of the canister while mitigating an undesirable increase in weight and material). These as well as other features of the present invention will become more apparent upon reference to the drawings.

DETAILED DESCRIPTION

The detailed description set forth below in connection with the appended drawings is intended as a description of certain embodiments of the present disclosure, and is not intended to represent the only forms that may be developed or utilized. The description sets forth the various functions in connection with the illustrated embodiments, but it is to be understood, however, that the same or equivalent functions may be accomplished by different embodiments that are also intended to be encompassed within the scope of the present disclosure. It is further understood that the use of relational terms such as top and bottom, first and second, and the like are used solely to distinguish one entity from another without necessarily requiring or implying any actual such relationship or order between such entities.

Figure 2:
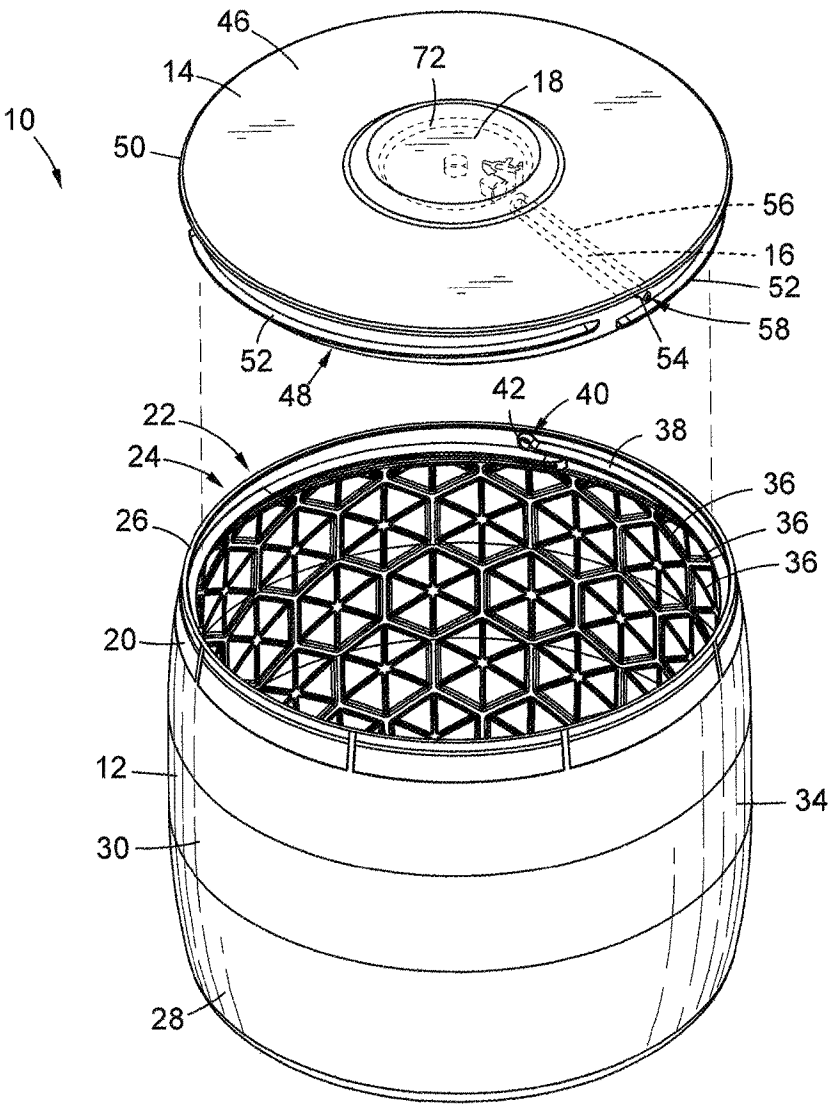
FIG. 2 is an exploded view thereof.
Figure 1:
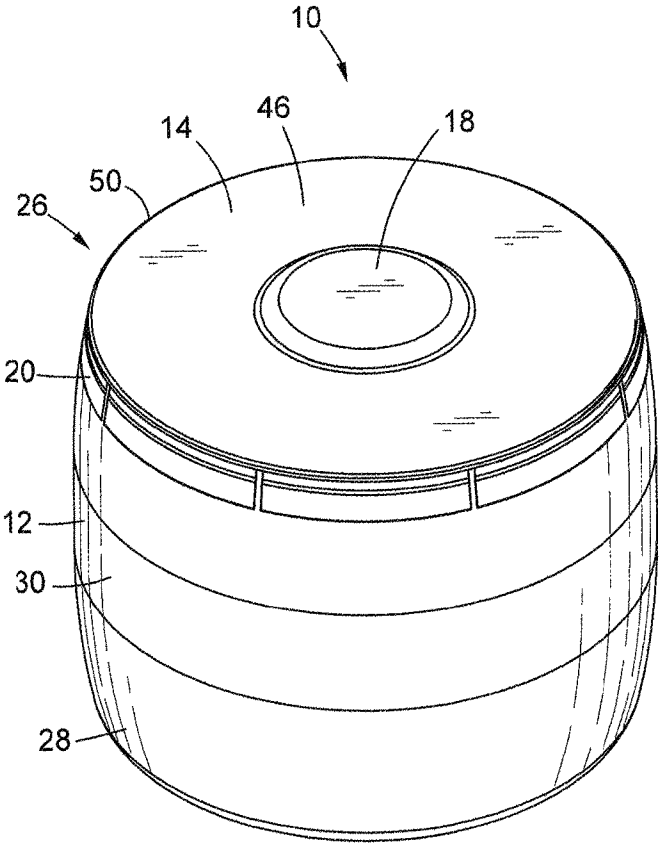
FIG. 1 is a perspective view of the tamper-resistant container of the present invention shown in a closed configuration.
Figure 4:
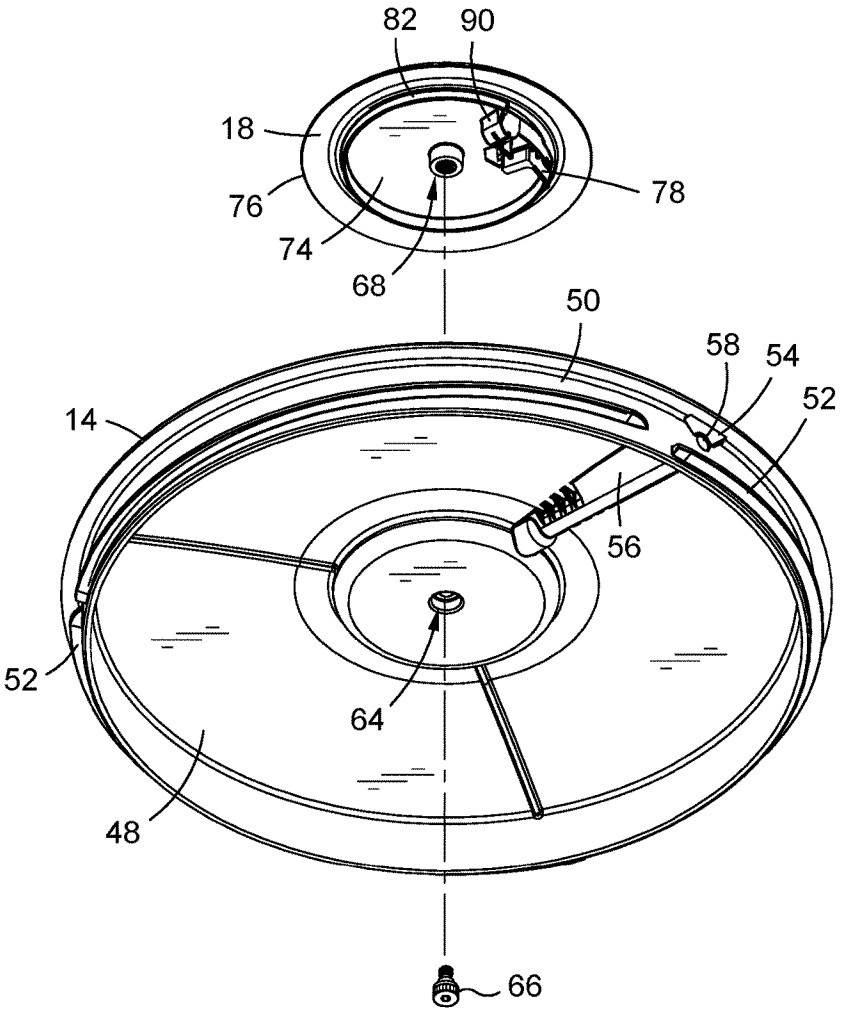
FIG. 4 is a lower perspective exploded view thereof.
Figure 3:
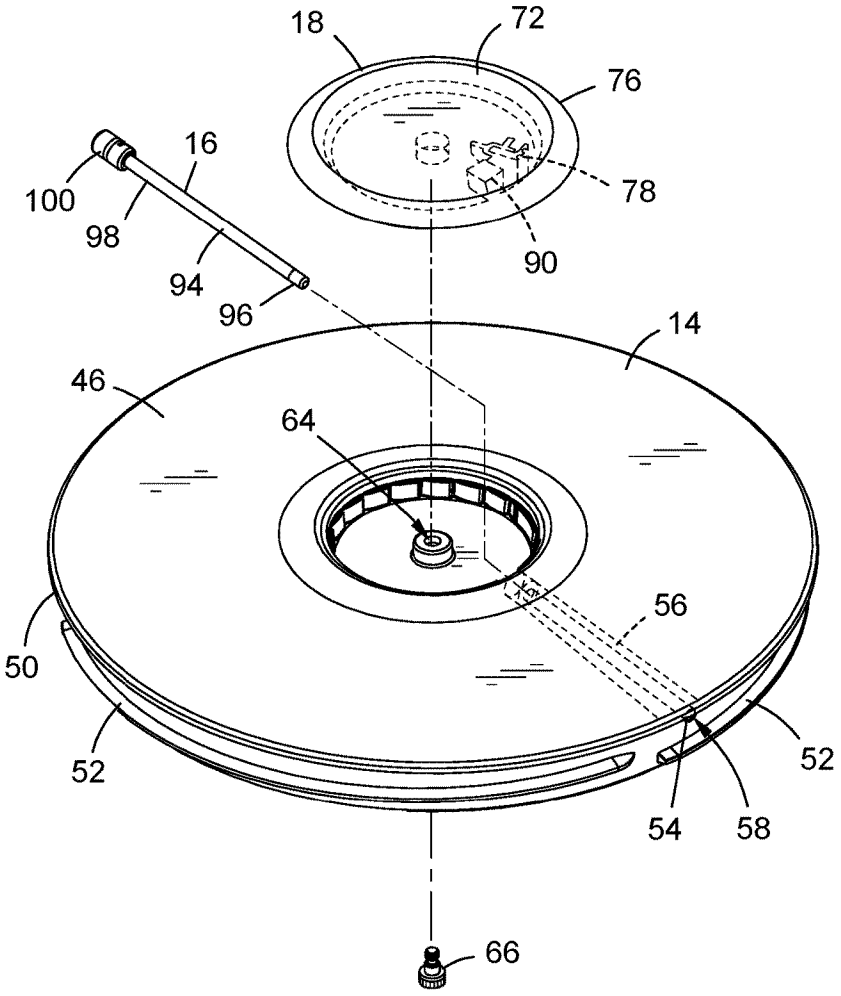
FIG. 3 is an exploded view of the locking disc and locking pin.
Figure 6:
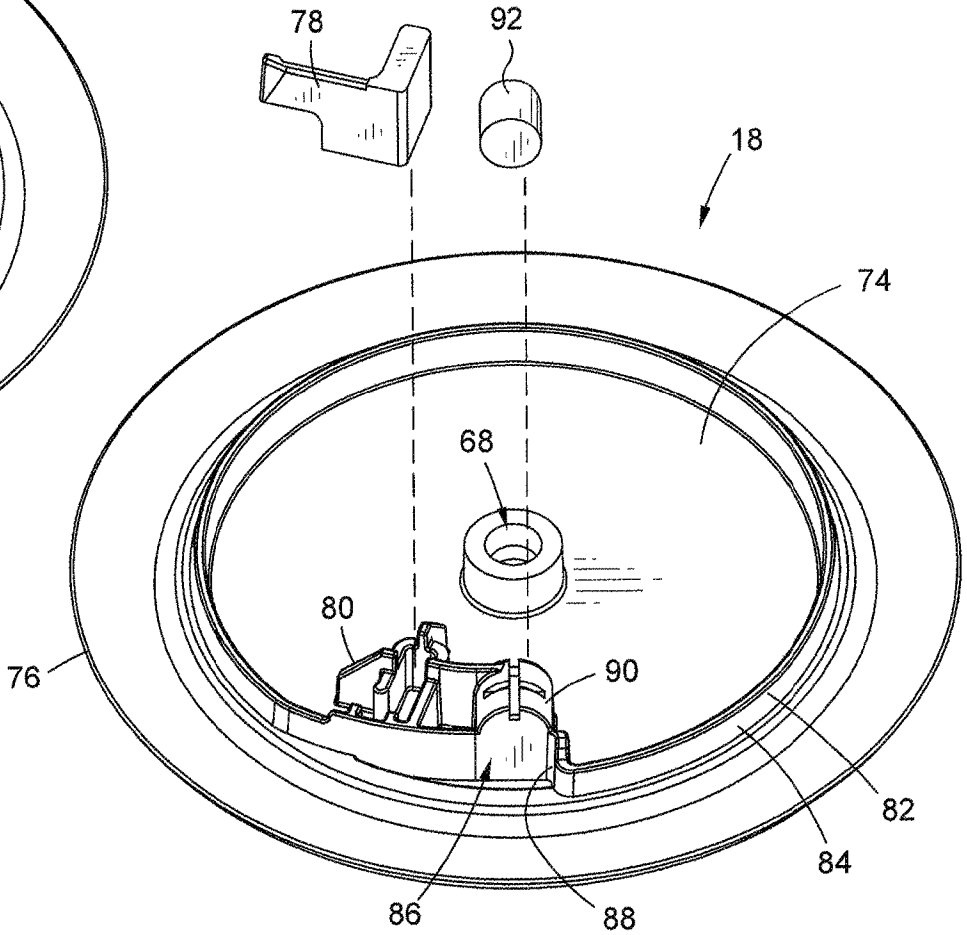
FIG. 6 is an exploded view thereof.

Referring now to FIGS. 1 and 2, there is provided a tamper-resistant container 10. The tamper-resistant container 10 includes a canister 12 and a lid 14. In addition, as will be discussed in further detail below, the tamper-resistant container 10 further includes a locking pin 16 and a locking disc or locking actuation knob or actuator 18.

According to an embodiment, the tamper-resistant container 10 includes the canister 12 having a canister rim 20 defining an opening 22 extending into a canister chamber 24. The lid 14 is sized and configured to engage the canister rim 20 for closure of the opening 22. The locking pin 16 has a locked position with the locking pin 16 being engaged with the canister 12 for mitigating disengagement of the lid 14 from the canister rim 20. The locking pin 16 has an unlocked position with the locking pin 16 being unengaged with the canister 12. The locking disc 18 is attached to the lid 14. The locking disc 18 is sized and configured to move the locking pin 16 from the unlocked position to the locked position upon rotation of the locking disc 18 in relation to the lid 14.

According to various embodiments, referring additionally to FIGS. 9-13, the canister 12 may include a canister top 26, a canister bottom 28 and a canister side wall 30. In this embodiment the canister 12 is of the general shape of a cylinder and the canister side wall 30 is generally cylindrical shaped. The canister rim 20 is disposed at the canister top 26.

The portions of the canister side wall 30 may be smoothly tapered or rounded adjacent the canister top 26 and the canister bottom 28 so as to mitigate the ability to readily grip the canister 12. The canister 12 includes an inner surface 32 and an outer surface 34. The inner surface 32 defines the canister chamber 24. The outer surface 34 may be generally smooth in texture to further mitigate the ability to readily grip the canister 12.

The canister 12 is desirable to be able to withstand significant forces and warping, such as would be expected when a bear attempts to access the contents of the container 10. In this regard, the canister 12 may be formed of a durable tough plastic material such as an injection molded polycarbonate. In addition, the canister 12 may include structural ribs 36 distributed within the canister side walls 30 and defining the inner surface 32. The structural ribs 36 may be used to enhance the structural integrity (i.e., provide increased compaction/crush strength) of the canister 12 while mitigating an undesirable increase in weight and material. The structural ribs 36 may be configured in a honeycomb or other geometric arrangement. In the embodiment depicted, the structural ribs 36 are disposed in a hexagon honeycomb pattern which is further subdivided into triangular shapes. Additionally, the canister 12 may be formed of a material that is semi-transparent/semi-translucent so as to enable the user to see the contents or at least see the extent to which the canister chamber 24 is filled and with what contents. As such, a polycarbonate material may be used. The particular material, sizing and techniques of manufacturing of the canister 12 may be selected from those which are well known to one of ordinary skill in the art.

The canister rim 20 may include rim threads 38. In this embodiment the rim threads 38 are disposed along the inner surface 32 and are internally facing. The rim threads 38 are used to engage the lid 14. In addition the canister 12 may include a locking socket 40 for interacting with the locking pin 16, and may further include a stop 42 for interacting with the lid 14 as discussed in more detail below.

Referring additionally to FIGS. 3-8, the lid 14 includes a lid body 44, a top side 46 and an opposing bottom side 48, and a lid outer periphery 50 disposed between the top side 46 and the bottom side 48. The lid 14 includes lid threads 52 disposed about the lid outer periphery 50. The lid threads 52 are cooperatively formed with the rim threads 38 to allow for the lid 14 to be threadedly engaged with the canister 12. In the top perspective view of FIG. 2, the lid 14 is rotated clockwise to threadedly engage the lid 14 with the canister 12. Surface friction by the user at the top side 46 of the lid 14 is used to rotate the lid 14 to screw the lid 14 into the canister 12.

The lid 14 may further include a protrusion 54. The protrusion 54 may be disposed at the lid outer periphery 50. The protrusion 54 is cooperatively sized and configured to contact the stop 42 of the canister 12. This prevents the lid 14 from being further screwed into the canister 12 and indexes the angular position of the lid 14 with respect to the canister 12.

While in this embodiment the lid threads 52 are formed to be outward facing so as to engage the inward facing rim threads 38 of the canister 12. This allows the lid 14 to be inset within the canister rim 20. As such, the lid 14 is resistant to the lid outer periphery 50 from being readily gripped so as to be attempted to be unscrewed. However, it is contemplated that the threads of the lid 14 may be formed to be inward facing and complementary threads of the canister 12 may be formed to be outward facing.

The lid 14 may further include a pin channel 56 and a pin hole 58. The pin channel 56 disposed radially within the lid body 44. The pin channel 56 is sized and configured to receive the locking pin 16 therein. The pin channel 56 extends to the pin hole 58. The pin hole 58 is disposed at the pin outer periphery 50. As mentioned above the protrusion 54 and the stop 42 are used to index the lid 14 with the canister 12. In this regard, with the protrusion 54 in contact with the stop 42, the pin hole 58 is aligned with the locking socket 40 of the canister rim 20. The pin hole 58 and the locking socket 40 are sized and configured to receive the locking pin 16 upon the locking pin 16 being longitudinally extended radially along the pin channel 56.

The lid 14 includes a disc cavity 60 formed in the lid body 44 at the top side 46. The disc cavity 60 includes a cavity inner periphery 62. The disc cavity 60 and the cavity inner periphery 62 are sized and configured to receive a portion of the locking disc 18 therein. The lid 14 includes a central opening 64 that extends through the lid body 44 in the disc cavity 60. A fastener 66, such as in the form of a bolt, may be used to attach the locking disc 18 with the lid 14. The locking disc 18 may have a fastener hole 68. The fastener hole 68 may have internal threads. The fastener 66 may extend through the central opening 64 and into the fastener hole 68 to threadedly engage the fastener 66. The fastener 66 is used to securely attach the locking disc 18 to the lid 14 and allow the locking disc 18 to rotate about the fastener 66 in relation to the lid 14. It is contemplated that other arrangements for rotatably attaching the locking disc 18 to the lid 14 may be selected from those which are well known to one of ordinary skill in the art.

The lid 14 includes a plurality of paws 70 distributed about the cavity inner periphery 62. The paws 70 are inward facing and used to restrict the direction of rotation of the locking disc 18. In this regard, the locking disc 18 includes a disc top side 72, disc bottom side 74 and a disc periphery 76. The locking disc 18 may further include a ratchet 78 and a ratchet housing 80. The ratchet housing 80 is integrally formed in the locking disc 18 at the disc bottom side 74. The ratchet housing 80 is configured to support the ratchet 78. The ratchet 78 is cooperatively sized and configured with the paws 70 so as to restrict the direction of rotation of the locking disc 18. In the top perspective view of FIGS. 1 and 2, the locking disc 18 is configured to rotate in a clockwise direction with the ratchet 78 configured to slide along the paws 70. It is contemplated that attempted rotation of the locking disc 18 in a counter-clockwise direction would result in the ratchet 78 interlocking with one of the paws 70 to resist such rotation.

It is contemplated that such controlled rotational directionality has the benefit of being in the same rotational direction as the direction of the lid for engaging the lid 14 with the canister 12. In this respect with the lid 14 fully screwed into the canister 12, clockwise rotation of the locking disc 18 would result generally in the same directionality of forces upon the lid when rotating the locking disc. Otherwise, if the locking disc 18 were to be allowed to rotate in a counter-clockwise direction, this may result in the lid 14 being undesirably unscrewed. Further, such controlled rotational directionality has the benefit of rotating the locking disc 18 in a direction opposite of the fastener 66 having traditional threading. The rotation of the locking disc 18 would tend to urge the fastener 66 to being screwed into the fastener hole 68.

The disc periphery 76 may be overlapping with the top side 46 of the lid 14. The disc bottom side 74 is disposed in tight contact with the top side 46 of the lid 14 so as to seal the disc cavity 60 therein. The disc top side 72 may be sloped or beveled towards the disc periphery 76. This advantageously diverts any liquid, such a rain water or dew, radially outward from the disc periphery 76. Further, the top side 46 of the lid 14 may include an annular shoulder or sloped surface contour to further radially divert liquid from the top side 46 of the lid 14.

The locking disc 18 includes a side wall 82 extending from the disc bottom side 74. The side wall 82 is integrally formed with the locking disc 18. The side wall 82 includes a side wall outer surface 84 that is configured to face outwardly towards the cavity inner periphery 62. The side wall 82 is generally circular shaped with a slight spiral configuration centered about the fastener hole 68. In this regard the side wall 82 includes a stepped section 86 having a step riser 88.

The locking disc 18 includes a first magnetic element housing 90 and a first magnetic element 92. In the embodiment depicted, the first magnetic element housing 90 is integrally formed with the locking disc 18 at the disc bottom side 74. The first magnetic element housing 90 is sized and configured to retain the first magnetic element 92.

Figure 5:
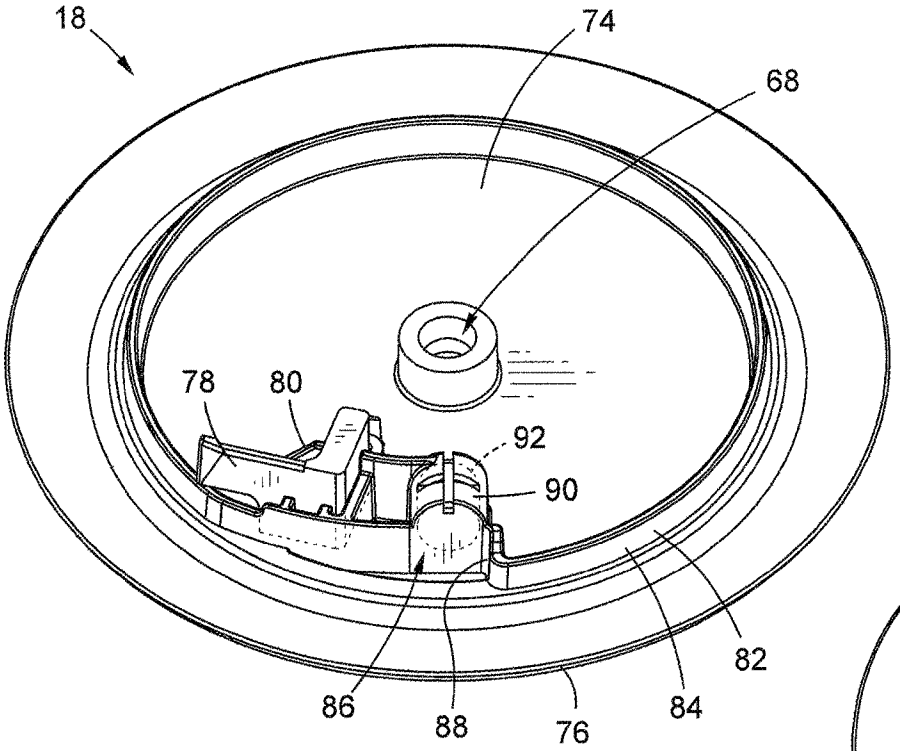
FIG. 5 is a perspective view of the underside of the container top or lid of the present invention.
Figure 8:
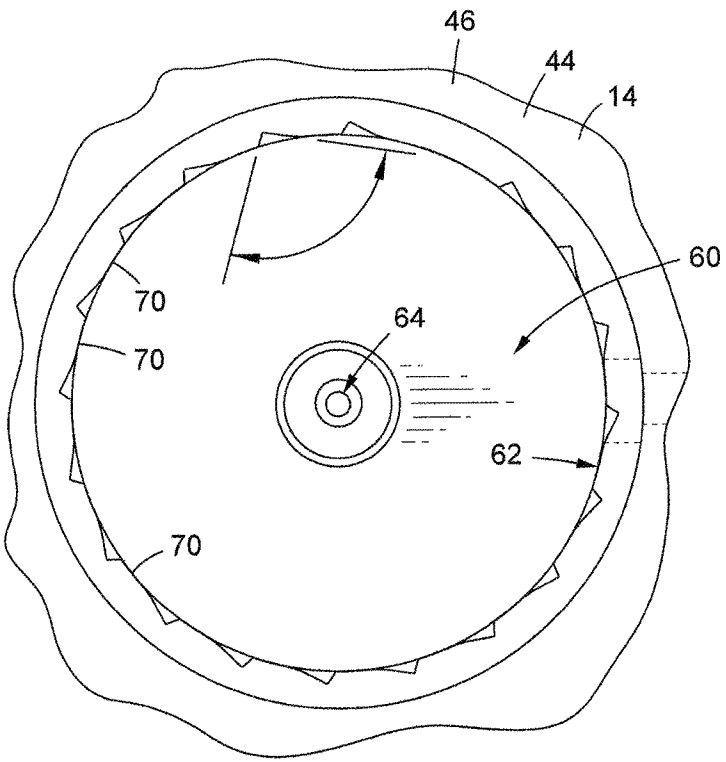
FIG. 8 is an enlarged plan view thereof.
Figure 7:
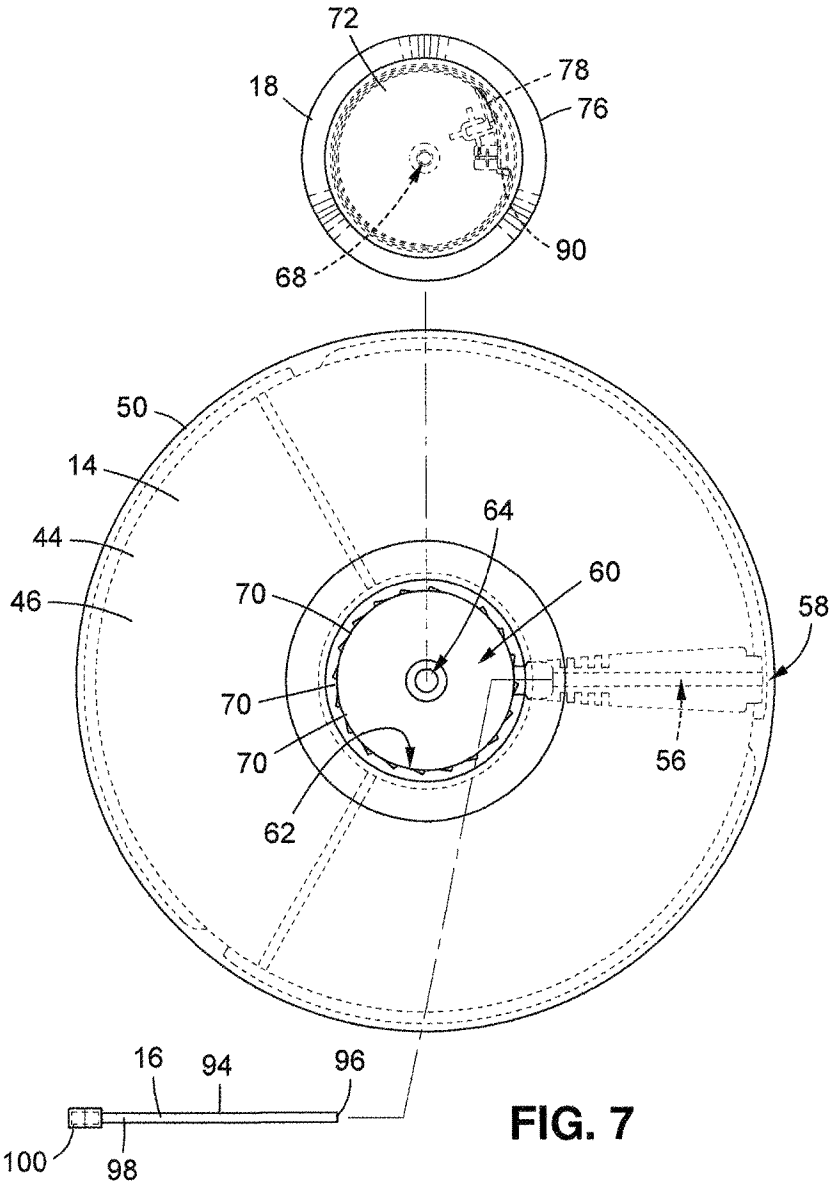
FIG. 7 is an exploded view thereof.

In the embodiment depicted, the stepped section 86 is disposed adjacent the magnetic element housing 90. In the view of FIG. 5, the radial distance of the side wall outer surface 84 from the fastener hole 68 is at a maximum immediately counter-clockwise from the step riser 88. The radial distance of the side wall outer surface 84 from the fastener hole 68 is at a minimum at the stepped section 86 immediately adjacent the magnetic element housing 90 just clockwise from the step riser 88. In this regard, the radial distance of the side wall outer surface 84 from the fastener hole 68 increases from the stepped section 86 in a clockwise direction.

Figure 9:
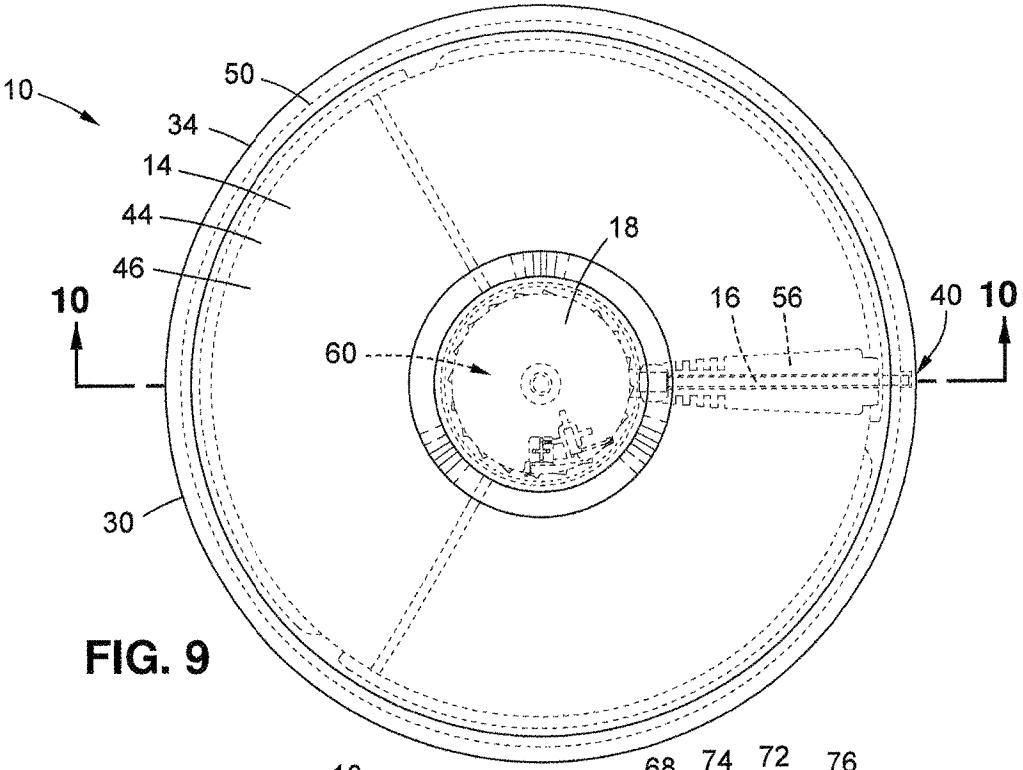
FIG. 9 is a top plan view thereof.
Figure 10:
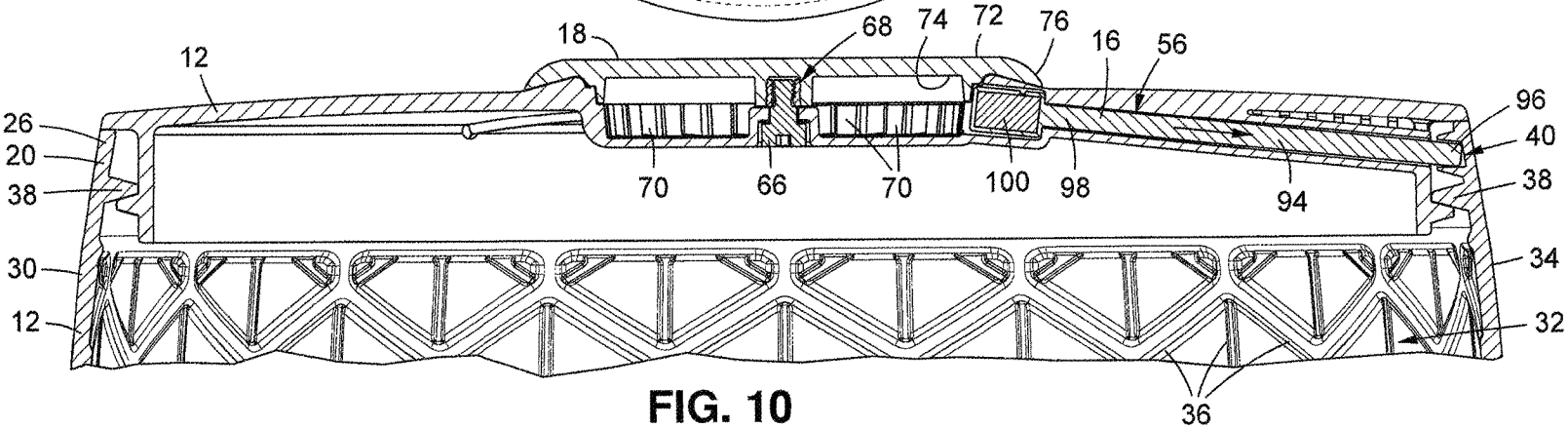
FIG. 10 is a cross sectional view taken about lines 10-10 of FIG. 9.
Figure 11:
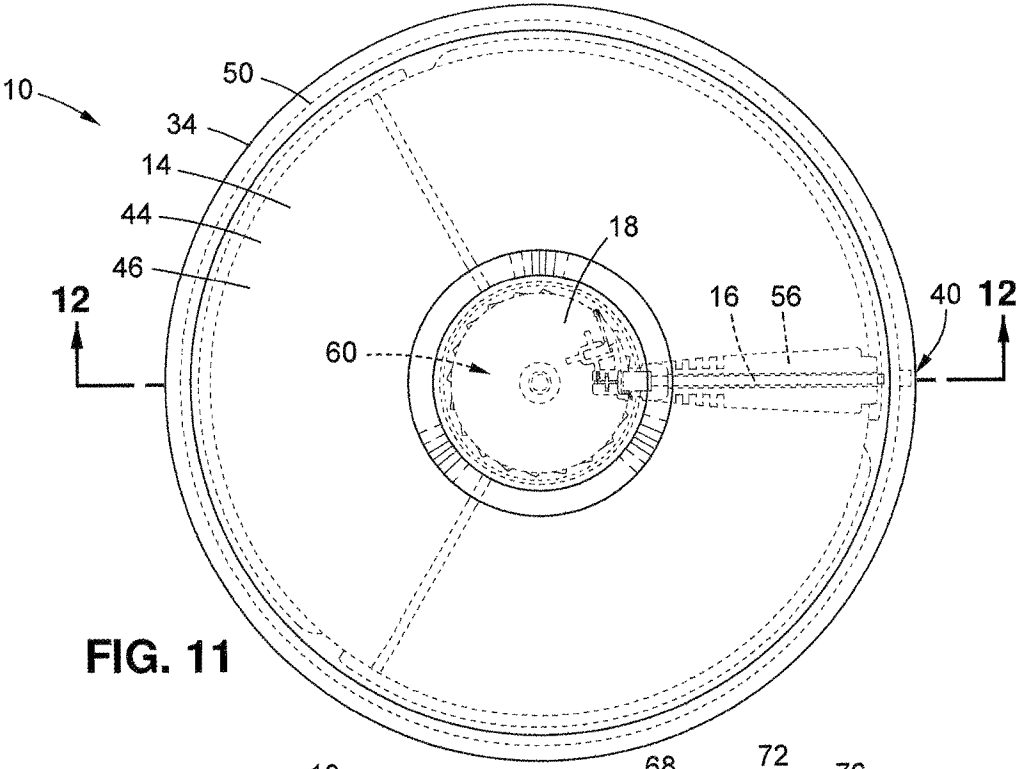
FIG. 11 is top plan view thereof.

As mentioned above, the locking pin 16 has a locked position with the locking pin 16 being engaged with the canister 12 for mitigating disengagement of the lid 14 from the canister rim 20. As used herein, the term locked position refers to the locking pin 16 being in a position which resists movement of the lid 14 from being removed from the canister 12 in comparison to being in the unlocked position. The pin channel 56 is sized and configured to receive the locking pin 16 therein. The locking pin 16 is configured to be in slidable contact within the pin channel 56. The lid 14 may be angularly positioned so as to align the pin hole 58 with the locking socket 40. This allows the locking pin 16 to slide radially outward within the pin channel 56 and through the pin hole 58 and with the distal end 96 extending into the locking socket 40 such as depicted in FIGS. 9 and 10. With the distal end 96 being extended into the locking socket 40 this results in the locking pin 14 being in a locked position as the locking pin 14 interferes with the rotation of the lid 14 relative to the canister 12.

As further mentioned above, the locking pin 16 has an unlocked position with the locking pin 16 being unengaged with the canister 12. As used herein, the term unlocked position refers to the locking pin 16 being in a position which does not resist movement of the lid 14 from being removed from the canister 12. In this regard, the locking pin 14 may be positioned along the pin channel 56 such that the distal end 96 of the locking pin 14 is not extended within the locking socket 40. It is contemplated that the locking pin 14 may be unlocked whether or not the pin hole 58 is aligned with the locking socket 40.

The locking pin 16 includes a stem 94 and a distal end 96 and an opposing inner end 98. The locking pin further includes a second magnetic element 100 disposed at the inner end 98. The first magnetic element 92 and the second magnetic element 100 are magnetically complementary so as to be magnetically attractive with the inner end 98 of the locking pin 16 being positioned at the stepped section 86 adjacent the first magnetic element housing 90. In this regard, the first magnetic element 92 may be a magnet, and the second magnetic element 100 may be also be a magnet with magnetic polarities of the first and second magnetic elements 92, 100 being opposite immediately adjacent each other. In another arrangement, the second magnetic element 100 may formed of a ferromagnetic metal. In this regard, the second magnetic element 100 may be a distinct component from the attached stem 94, or may be integrally formed with the stem 94 with the entire locking pin 14 being formed of a same material.

The first and second magnetic elements 92, 100 and the locking pin 14 are cooperatively sized and configured such that the magnetic attractive forces between the first and second magnetic elements 92, 100 are sufficient to move the locking pin 14 from the locked position to the unlocked position. Upon such attraction, it is contemplated that the inner end 98 of the locking pin 14 is disposed in contact with the side wall 82 at the stepped section 86 immediately adjacent to and aligned with the first magnetic element housing 90. In such a position, the first and second magnetic elements 92, 100 are at a minimum separation distance.

Figure 12:
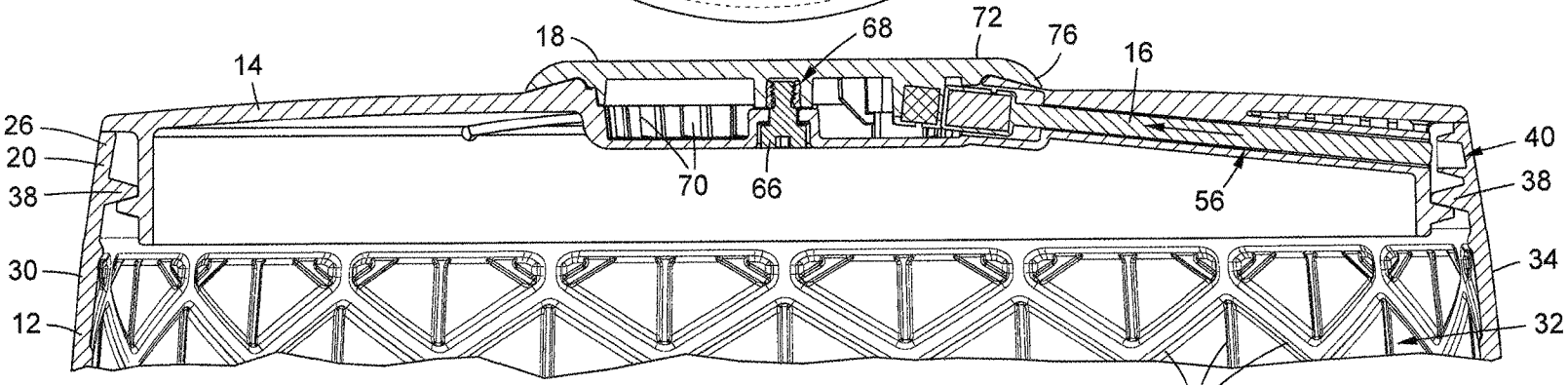
FIG. 12 is a cross sectional view taken about lines 12-12 of FIG. 11.
Figure 13:
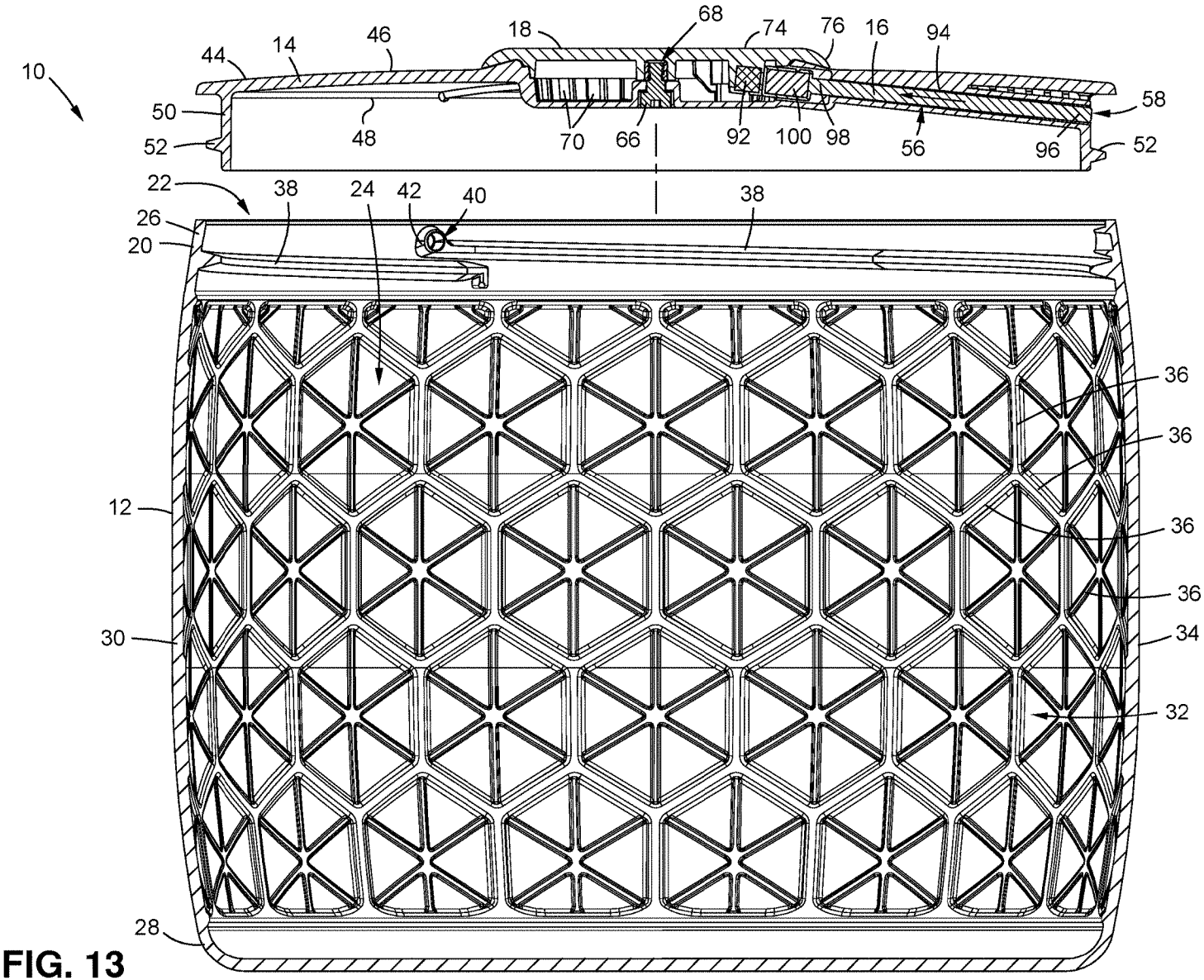
FIG. 13 is a cross sectional view thereof.

From the unlocked position with the locking pin 14 adjacent stepped section 86, the locking disc 18 may be rotated clockwise (in relation to the views of FIGS. 1, 2 and 9). This moves the stepped section 86 away from the locking pin 14. As the radial distance of the side wall outer surface 84 from the fastener hole 68 increases from the stepped section 86 in a clockwise direction (in relation to the views of FIGS. 1, 2 and 9), this results in the side wall 82 effectively "pushing" the inner end 98 of the locking pin 14 radially outward upon clockwise rotation of the locking disc 18 (in relation to the views of FIGS. 1, 2 and 9). To the extent that the pin hole 58 is aligned with the locking socket 40, such pushing of the locking pin 14 would eventually result in the distal end 96 extending into the locking socket 40 and the locking pin 14 moving into the locked position (such as depicted in FIGS. 9 and 10). To further assist in the locking pin 14 from being slid within the pin channel 56 from the unlocked position into the locked position, the pin channel 56 may be slightly sloped in comparison to being horizontal with the container 10 in an upright position, such as depicted in FIGS. 10 and 12.

The particular material, sizing and techniques of manufacture of the lid 14 and locking disc 18 may be selected from those which are well known to one of ordinary skill in the art. Like the canister 12, the lid 14 and locking disc 18 may be formed of a plastic material such as an injection molded polycarbonate.

The particulars shown herein are by way of example only for purposes of illustrative discussion, and are presented in the cause of providing what is believed to be the most useful and readily understood description of the principles and conceptual aspects of the various embodiments set forth in the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A tamper-resistant container comprising:

a canister having a canister rim defining an opening extending into a canister chamber;

a lid sized and configured to engage the canister rim for closure of the opening by rotation of the lid in a first rotational direction relative to the canister rim;

a locking pin, the locking pin having a locked position with the locking pin being engaged with the canister for mitigating disengagement of the lid from the canister rim, the locking pin having an unlocked position with the locking pin being unengaged with the canister; and a locking disc attached to a top side of the lid opposite the canister so as to be manually accessible from outside while the lid is engaged with the canister rim, the locking disc being sized and configured to move the locking pin from the unlocked position to the locked position upon rotation of the locking disc in the first rotational direction in relation to the lid, wherein the lid is configured to prevent rotation of the locking disc in a second rotational direction opposite the first rotational direction.

2. The tamper-resistant container of claim 1 wherein the locking pin is slidably attached to the lid.

3. The tamper-resistant container of claim 2 wherein the locking disc includes first magnetic element and the locking pin includes a second magnetic element, the first and second magnetic elements are sized and configured to magnetically interact with each other.

4. The tamper-resistant container of claim 3 wherein the locking disc is sized and configured to slide the locking pin from the locked position to the unlocked position upon the locking disc being rotated to a position with the first magnetic element aligned with the second magnetic element.

5. A method of using a tamper-resistant container, the method comprising:

(a) providing the tamper-resistant container of claim 1;

(b) engaging the lid with the canister rim for closure of the opening; and (c) rotating the locking disc to move the locking pin from the unlocked position to the locked position with the locking pin being engaged with the canister for mitigating disengagement of the lid from the canister rim.

6. The method of using a tamper-resistant container of claim 5 wherein step (b) includes rotating the lid relative to the canister rim to threadedly engage the lid with the canister rim.

7. The method of using a tamper-resistant container of claim 5 wherein the locking disc includes a first magnetic element and the locking pin includes a second magnetic element, the first and second magnetic elements being sized and configured to magnetically interact with each other, the method further including:

(d) rotating the locking disc to align the first magnetic element with the second magnetic element to slide the locking pin from the locked position to the unlocked position.

8. A tamper-resistant container comprising:

a canister having a canister rim defining an opening extending into a canister chamber;

a lid sized and configured to engage the canister rim for closure of the opening by rotation of the lid in a first rotational direction relative to the canister rim;

a locking pin, the locking pin having a locked position with the locking pin being engaged with the canister for mitigating disengagement of the lid from the canister rim, the locking pin having an unlocked position with the locking pin being unengaged with the canister;

an actuator attached to a top side of the lid opposite the canister so as to be manually accessible from outside while the lid is engaged with the canister rim, the actuator being sized and configured to move the locking pin from the unlocked position to the locked position upon rotation of the actuator in the first rotational direction in relation to the lid, wherein the lid is configured to prevent rotation of the actuator in a second rotational direction opposite the first rotational direction; and the canister being formed of a polymer material having a plurality of structural ribs to increase the structural strength of the canister.

9. The tamper-resistant container of claim 8 wherein the structural ribs are formed on an interior surface of the canister chamber.

10. The tamper-resistant container of claim 9 wherein the structural ribs are formed in a honeycomb geometric configuration.

11. The tamper-resistant container of claim 10 wherein the actuator comprises a locking disc including a first magnetic element and the locking pin includes a second magnetic element, the first and second magnetic elements being sized and configured to magnetically interact with each other.

12. The tamper-resistant container of claim 11 wherein the locking disc is sized and configured to slide the locking pin from the locked position to the unlocked position upon the locking disc being rotated to a position with the first magnetic element aligned with the second magnetic element.

13. The tamper-resistant container of claim 12 wherein the canister is formed from an injection molded polymer material.

* * * * *